US008981196B2

(12) United States Patent
Patel

(10) Patent No.: US 8,981,196 B2
(45) Date of Patent: Mar. 17, 2015

(54) ILLUMINATING TOOTHBRUSH

(71) Applicant: Ashtel Studios Inc., Fontana, CA (US)

(72) Inventor: Anish Patel, Fontana, CA (US)

( * ) Notice: Subject to any disclaimer, the term of this patent is extended or adjusted under 35 U.S.C. 154(b) by 219 days.

(21) Appl. No.: 13/649,065

(22) Filed: Oct. 10, 2012

(65) Prior Publication Data

US 2013/0039039 A1 Feb. 14, 2013

Related U.S. Application Data

(63) Continuation-in-part of application No. 13/172,942, filed on Jun. 30, 2011, now Pat. No. 8,468,638.

(51) Int. Cl.

| | |
|---|---|
| ***A63B 47/04*** | (2006.01) |
| ***B60S 3/00*** | (2006.01) |
| ***A46B 7/04*** | (2006.01) |
| ***A46B 15/00*** | (2006.01) |

(52) U.S. Cl.

CPC ..... *A46B 7/04* (2013.01); *A46B 15/0002* (2013.01); *A46B 15/0028* (2013.01); *A46B 15/004* (2013.01); *A46B 15/0081* (2013.01)

USPC ..... 84/464 R; 15/22.1; 15/167.1

(58) Field of Classification Search

USPC ..... 84/464 R

See application file for complete search history.

(56) References Cited

U.S. PATENT DOCUMENTS

| | | | | |
|---|---|---|---|---|
| 5,956,796 | A | 9/1999 | Lodato | |
| 6,154,912 | A * | 12/2000 | Li | 15/105 |
| 7,143,462 | B2 | 12/2006 | Hohlbein | |
| 7,418,757 | B2 * | 9/2008 | Gatzerneyer et al. | 15/105 |
| 7,845,041 | B2 | 12/2010 | Gatzemeyer et al. | |
| 8,051,520 | B2 | 11/2011 | Pfenniger et al. | |
| 8,544,132 | B2 * | 10/2013 | Gatzemeyer et al. | 15/22.1 |
| 2005/0066461 | A1 | 3/2005 | Chang | |
| 2005/0225971 | A1 | 10/2005 | Melnik | |
| 2006/0075588 | A1 * | 4/2006 | Amador | 15/167.1 |
| 2007/0261185 | A1 | 11/2007 | Guney et al. | |
| 2010/0024143 | A1 * | 2/2010 | Dickie | 15/167.1 |
| 2012/0137454 | A1 * | 6/2012 | Huy et al. | 15/22.1 |

OTHER PUBLICATIONS

"Non-Final Office Action" issued on Dec. 31, 2012 for U.S. Appl. No. 13/172,942.

"Final Office Action" dated Apr. 11, 2013 for U.S. Appl. No. 13/172,942.

* cited by examiner

*Primary Examiner* — Christopher Uhlir

(74) *Attorney, Agent, or Firm* — LeonardPatel PC

(57) ABSTRACT

One or more embodiments of the present invention pertain to an illuminating toothbrush. The toothbrush includes at least one illuminating device enclosed within a body of the apparatus. The toothbrush also includes an audio device configured to play audio when the apparatus is activated. The at least one illuminating device is configured to illuminate the body of the apparatus for the predetermined period of time when the audio is played. In certain embodiments, the at least one illuminating device is further configured to illuminate the body of the apparatus based on a beat of the audio.

17 Claims, 17 Drawing Sheets

ILLUMINATING TOOTHBRUSH

CROSS-REFERENCE TO RELATED APPLICATION

This application is a continuation-in-part of, and claims the benefit of, U.S. Non-Provisional Patent Application No. 13/172,942, filed on Jun. 30, 2011. The subject matter thereof is hereby incorporated herein by reference in its entirety.

FIELD

The present invention relates to a musical apparatus and, more particularly, to a musical apparatus configured to illuminate according to the beat of the music or sounds.

BACKGROUND

Toothbrushes, when used properly, are effective for improving dental hygiene. However, many times, the task of brushing one's teeth becomes tedious. As a result, people generally brush very quickly or even brush once a day rather than brushing two or three times a day for a two-minute duration, as recommended by the American Dental Association. Some toothbrushes now illuminate (or blink) for a period of one minute, and then require activation again in order to illuminate for another period of one minute. These toothbrushes may include four colors of light such that each segment (e.g., 30 seconds) may light up with a different color. However, this may not fully encourage or entertain a user of the toothbrush to brush his or her teeth for the two-minute duration. Thus, a musical apparatus configured to illuminate according to the beat of the music or sounds, or possibly for the duration of the music or sounds, may be beneficial.

SUMMARY

Certain embodiments of the present invention may provide solutions to the problems and needs in the art that have not yet been fully identified, appreciated, or solved by current musical toothbrushes. For example, one or more embodiments of the present invention pertain to a musical apparatus configured to illuminate according to the beat of the music or sound.

In one embodiment, an apparatus is provided. The apparatus includes at least one illuminating device enclosed within a body of the apparatus. The apparatus also includes an audio device configured to output audio for a predetermined period of time. The at least one illuminating device is configured to illuminate the apparatus for a predetermined period of time when the audio is played.

In another embodiment, an apparatus is provided. The apparatus includes at least one illuminating device enclosed within a body of the apparatus and at least one illuminating device enclosed within a head unit of the apparatus. The apparatus also includes an audio device configured to output audio for a predetermined period of time. The at least one illuminating device is configured to illuminate the apparatus for a predetermined period of time when the audio is played.

In yet another embodiment, an apparatus is provided. The apparatus includes a plurality of illuminating devices enclosed within the apparatus. The apparatus also includes at least one switch configured to cause an audio device to play audio and cause the plurality of illuminating devices to illuminate the apparatus for a predetermined period of time when the audio is played.

BRIEF DESCRIPTION OF THE DRAWINGS

For a proper understanding of the invention, reference should be made to the accompanying figures. These figures depict only some embodiments of the invention and are not limiting of the scope of the invention. Regarding the figures.

DETAILED DESCRIPTION OF THE EMBODIMENTS

It will be readily understood that the components of the invention, as generally described and illustrated in the figures herein, may be arranged and designed in a wide variety of different configurations. Thus, the detailed description of the embodiments is not intended to limit the scope of the invention as claimed, but is merely representative of selected embodiments of the invention.

The features, structures, or characteristics of the invention described throughout this specification may be combined in any suitable manner in one or more embodiments. For example, the usage of "certain embodiments," "some embodiments," or other similar language, throughout this specification refers to the fact that a particular feature, structure, or characteristic described in connection with an embodiment may be included in at least one embodiment of the invention. Thus, appearances of the phrases "in certain embodiments," "in some embodiments," "in other embodiments," or other similar language, throughout this specification do not necessarily all refer to the same embodiment or group of embodiments, and the described features, structures, or characteristics may be combined in any suitable manner in one or more embodiments.

One or more embodiments described herein pertain to a musical toothbrush configured to illuminate when audio (e.g., songs, music, sounds, beats, etc.) is played. One audio can be played while brushing in the morning and the other audio can be played while brushing at night, for example. The toothbrush may use soft bristles having an ergonomic design to clean plaque in hard-to-reach places and may utilize a tongue cleaner to clean the person's tongue. The toothbrush may also include replaceable brush heads, at least two musical buttons, and replaceable batteries.

Figure 1:
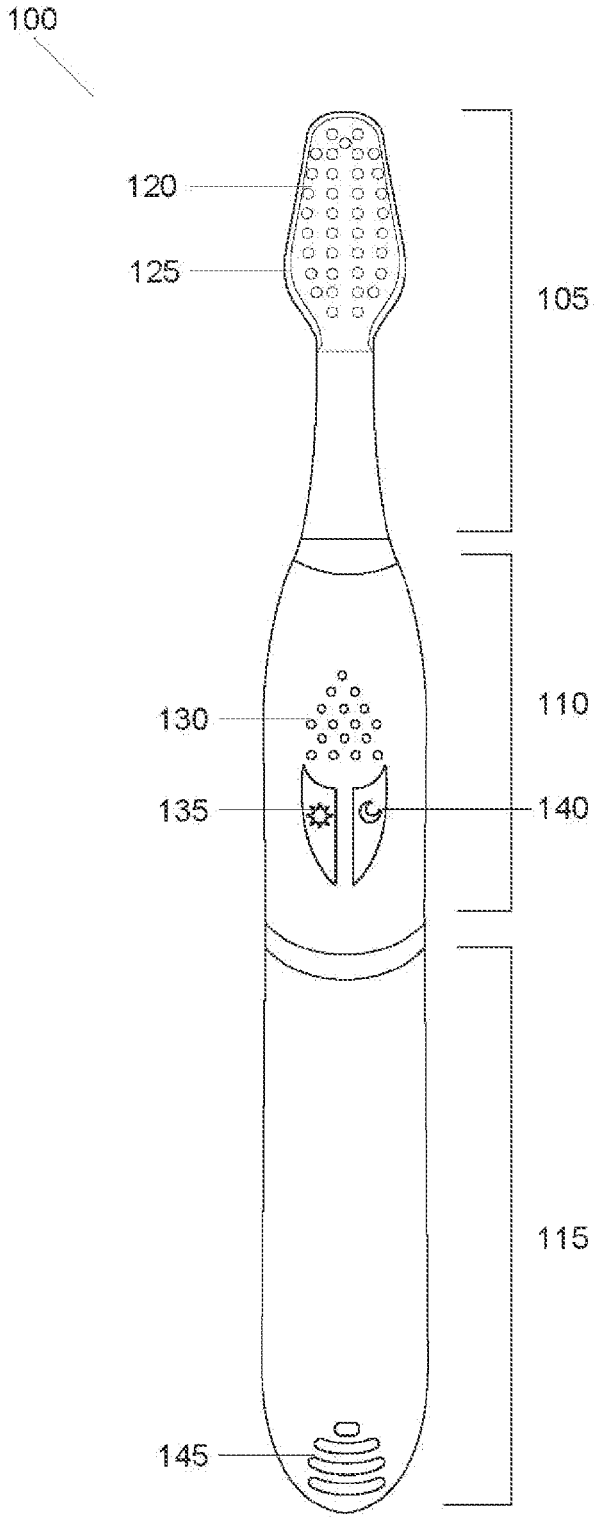
FIG. 1 illustrates a front-view of a musical toothbrush, in accordance with an embodiment of the present invention.

FIG. 1 illustrates a front-view of a toothbrush 100, in accordance with an embodiment of the present invention. Toothbrush 100 includes three components, i.e., a first component (or upper body) 105, a second component (or middle body) 110, and a third component (or lower body) 115. Each component may include an illuminating device (not shown) configured to illuminate when audio is played or illuminate based on the beat of the audio. It should be appreciated that in some embodiments that each component may illuminate separately or simultaneously. Illuminating devices may include light emitting diodes or any other light-emitting device as would be appreciated by a person of ordinary skill in the art.

It should be appreciated that each component may be composed of transparent or translucent material, such that a user can view the illuminated lights when audio is played. In another embodiment, each component may include slots (not shown) configured to allow light to illuminate from toothbrush 100. For example, each illuminating device may fit through each hole, such that illumination can be viewed when audio is played.

In this embodiment, first component 105 is a brush head that includes bristles 120 and a rubber coating 125. Bristles 120 can be multi-level and angled to help remove plaque more efficiently. Rubber coating 125 provides the user with a comfortable brushing experience. A person of ordinary skill in the art would appreciate that the coating need not be made of rubber, but can be any type of coating that would enhance the user's experience while brushing, such as certain plastics, fibers, woods, or any other suitable material. In certain embodiments, the illuminating device may illuminate rubber coating 125 when audio is played. In other embodiments, the illuminating device may illuminate a portion of, or the entirety of, first component 105. First component 105 may be attached to and detached from second component 110. In certain embodiments, second component 110 may include a locking mechanism configured to lock first component 105 in place. This allows the brush head to be replaced, for example, every three (3) months, as recommended by dentists.

Second component 110 is operatively connected to first component 105 and third component 115. Second component 110 includes a module (not shown) that includes a central processing unit (CPU) or processor, a battery, and a speaker, all of which are interconnected via electronic wiring. See FIGS. 7-9 for a more detailed description of the module. As discussed above, second component 110 may also include an illuminating device (not shown) that is configured to illuminate the entirety of, or part of, second component 110.

Second component 110 also includes a grip 130 and two buttons 135, 140. Grip 130 can be made of rubber, a rubber-like material, or any material that would enhance a user's experience of holding the toothbrush while brushing his or her teeth. While not in any particular order, button 135 can be configured to play audio, such as a song, sound and/or music, while brushing in the morning and button 140 can be configured to play music while brushing at night. Buttons 135, 140 may have an illustration of a sun and a moon, for instance, to instruct the user when to press the button.

Also, when button 135 or 140 is pressed, the music is activated and starts to play for two (2) minutes, which is the dentist recommended time to brush teeth. It should be appreciated that the duration of the music can be configured to play more or less than two minutes, as would be appreciated by one of ordinary skill in the art. If the user presses button 135 or 140 before the two-minute duration, then the music is deactivated and stops playing. If the user presses button 135 or 140 a subsequent time, the music is activated and plays for two minutes or until the music is deactivated. However, it should be appreciated that the music can be configured to continue to play from the time when the music was deactivated. When the audio is played, the illuminating device in each of the components is configured to illuminate in accordance with the beat of the audio.

Third component also includes an illuminating device also not shown. Third component 115 further includes sound apertures 145 to allow music waves to travel. Apertures 145 may also allow any water drawn into third component 115 to exit and mitigate against muffling of the music.

It should be appreciated that toothbrush 100 may be constructed in such a manner as to prevent bristles 120 from contacting, for example, a countertop in a bathroom. For instance, if toothbrush 100 is laid on its face, then second component 110 is configured to rotate to the left side or the right side of toothbrush 100. Such a configuration facilitates a more hygienic toothbrush.

Figure 2:
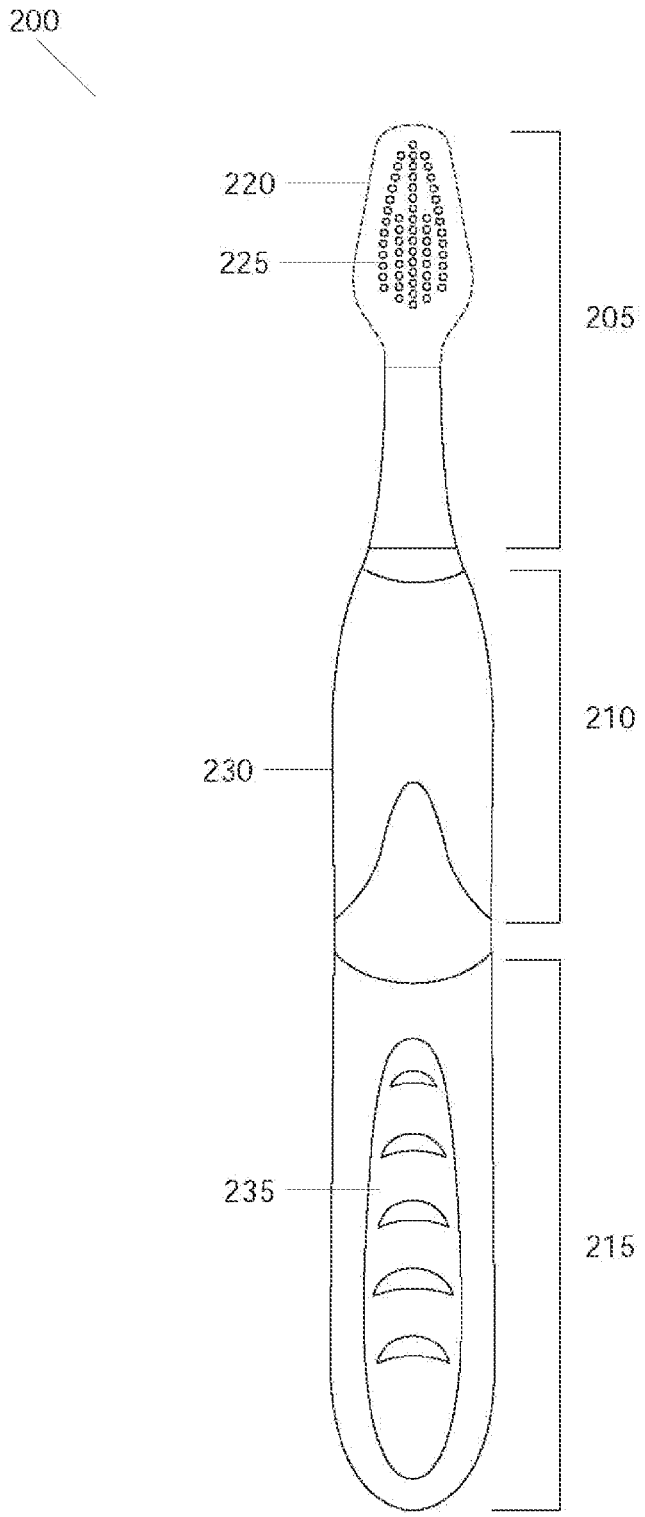
FIG. 2 includes a back-view of a musical toothbrush, in accordance with an embodiment of the present invention.

FIG. 2 includes a back-view of a musical toothbrush 200, in accordance with an embodiment of the present invention. Toothbrush 200 includes a first component 205, a second component 210, and a third component 215.

First component 205 includes a soft rubber coated material 220 to facilitate a comfortable brushing experience and a tongue cleaner 225 to allow a user to clean his or her tongue while brushing Second component 210 includes a first grip 230. First grip 230 can be made of a rubber material, or any material that would enhance a user's experience when holding the brush. Third component 215 includes a second grip 235 that can be made of rubber material, or any material that would enhance a user's experience when holding the brush.

It should be appreciated that the head of toothbrush 200 may be prevented from contacting, for example, a counter in a bathroom. For instance, the width of the left and the right side of second component 210 and third component 215 are configured such that toothbrush 200 is prevented from rotating and that neither the bristles nor tongue clear 225 contact the counter.

Figure 3:
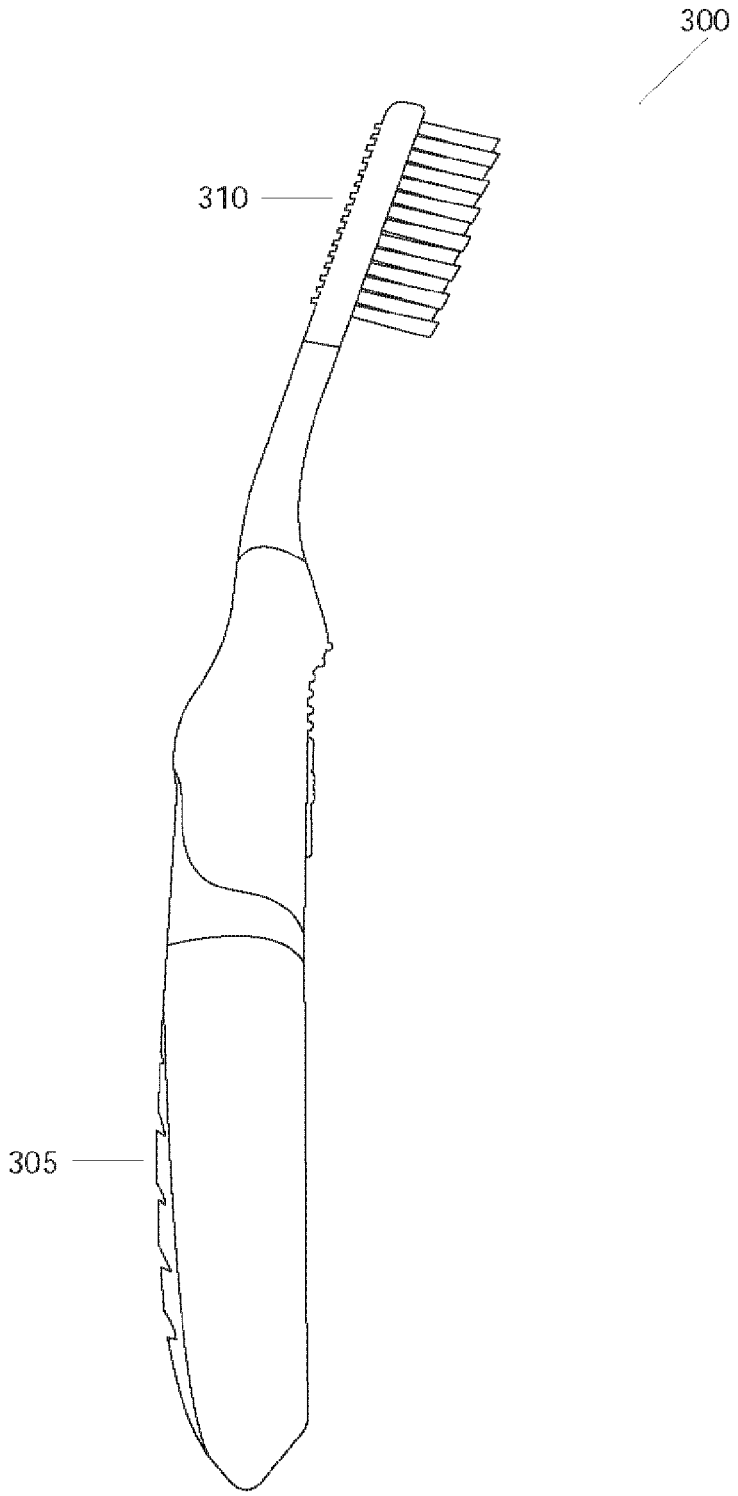
FIG. 3 illustrates a side-view of the musical toothbrush, in accordance with an embodiment of the present invention.

FIG. 3 illustrates a side-view of the musical toothbrush 300, in accordance with an embodiment of the present invention. For hygiene purposes, it should be appreciated that when back-portion 305 of toothbrush 300 is lying on the counter, tongue cleaner 310 is prevented from contacting the counter. This configuration prevents bacteria from directly contacting the tongue cleaner.

Figure 4:
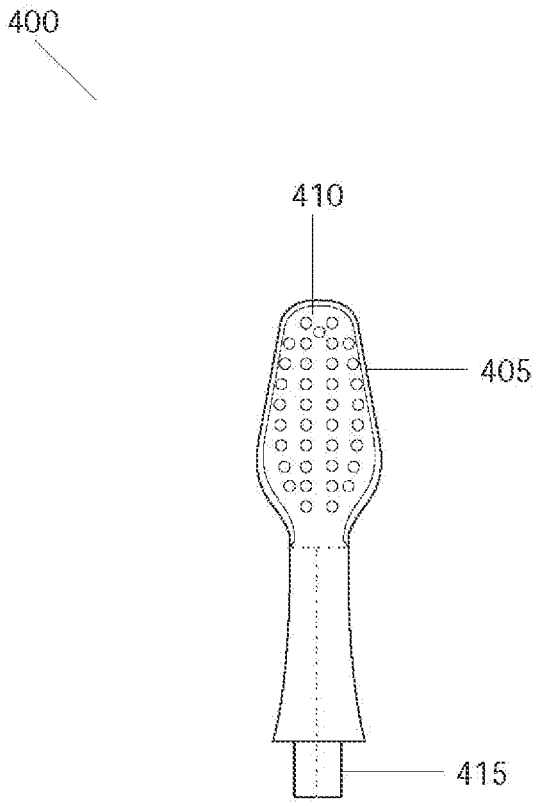
FIG. 4 illustrates a first component of the musical toothbrush, in accordance with an embodiment of the present invention.

FIG. 4 illustrates a first component 400 of the musical toothbrush, in accordance with an embodiment of the present invention. First component 400 includes a head of the toothbrush. The head of the toothbrush includes a soft outer coating 405 and bristles 410. First component 400 also includes a connector 415 that operatively connects first component 400 with the second component of the toothbrush. Connector 415 allows a user to replace the brush head every three (3) months, for example, as recommended by dentists.

Figure 5:
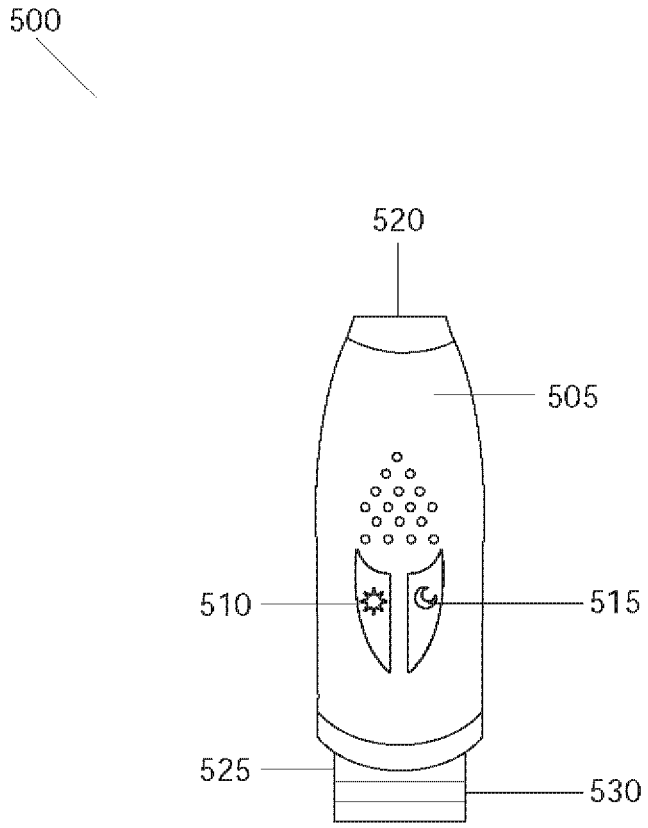
FIG. 5 illustrates a second component of the musical toothbrush, in accordance with an embodiment of the present invention.

FIG. 5 illustrates a second component 500 of the musical toothbrush, in accordance with an embodiment of the present invention. Second component 500 includes a grip 505, buttons 510 and 515, an opening 520, a connector 525, and a slot 530 for a waterproof band.

Opening 520 is configured to securely receive the connector of the first component such that the first component and the second component of the musical toothbrush securely fasten together. Connector 525 is configured to operatively connect second component 500 with the third component of the toothbrush. As a result, the second and third components of the toothbrush can securely fasten together.

Because second component 500 and the third component can house the processor, battery, and the audio device, connector 525 utilizes slot 530 for a waterproof band to prevent liquid or water from entering the second and third components. As a result, malfunctioning of the processor, battery, and/or audio device is significantly reduced.

Figure 6:
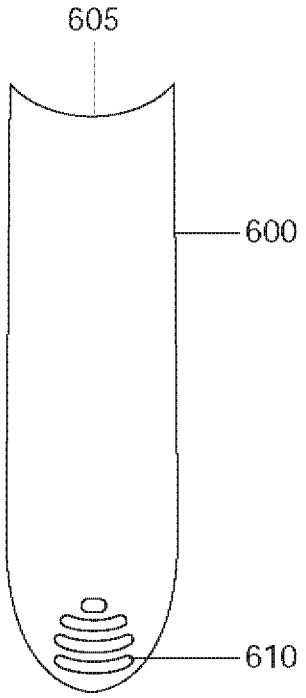
FIG. 6 illustrates a third component of the musical toothbrush, in accordance with an embodiment of the present invention.

FIG. 6 illustrates a third component 600 of the musical toothbrush, in accordance with an embodiment of the present invention. Third component 600 includes an opening 605 and apertures 610. Opening 605 is configured to securely receive the connector of the second component such that the second and third components of the toothbrush are securely fastened together. Also, portions of the module shown in FIGS. 7-9, can be securely placed within third component 600.

Figure 7:
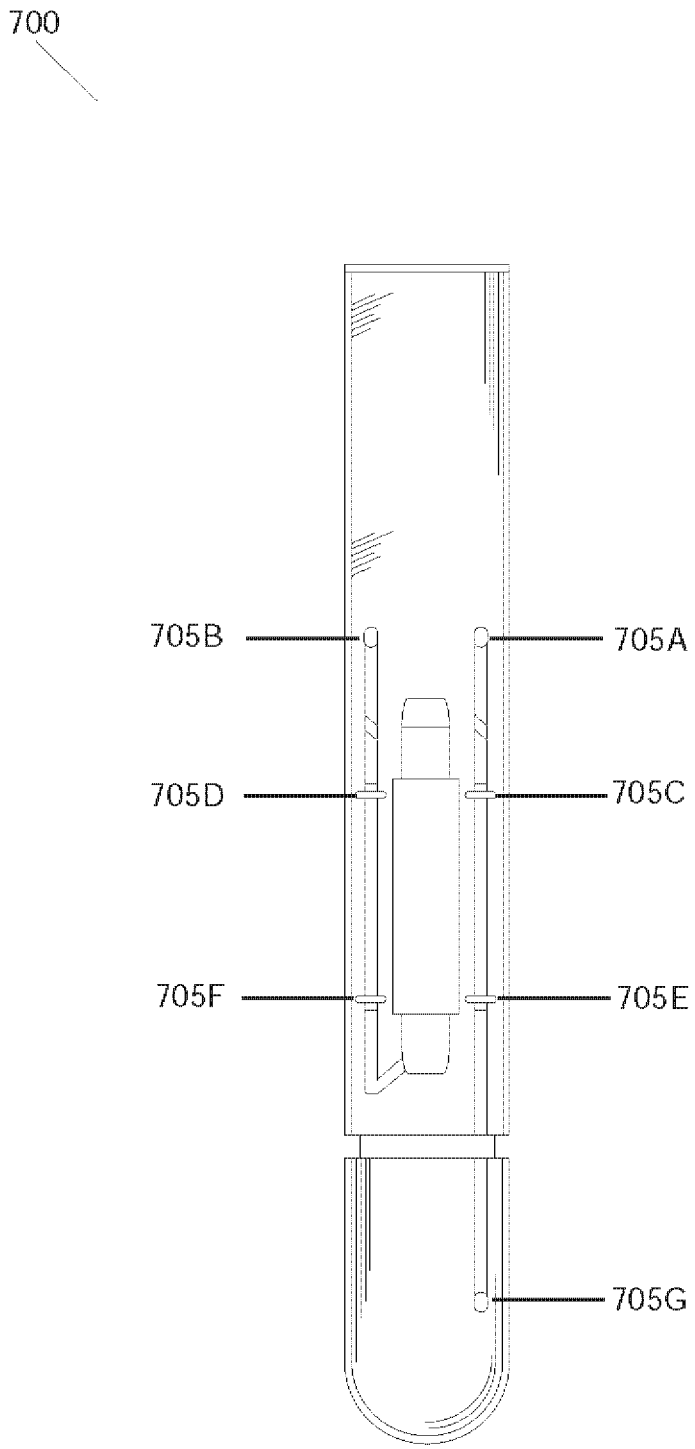
FIG. 7 illustrates a shell of a module of the musical toothbrush, in accordance with an embodiment of the present invention.

FIG. 7 illustrates a shell of a module 700 of the musical toothbrush, in accordance with an embodiment of the present invention. The body of module 700 includes at least seven welds 705A-G. Welds 705A-G are configured to electronically connect the processor, battery, and audio device via electronic cables. A person of ordinary skill in the art will readily appreciate that more or less than seven welds may be utilized in order to electronically connect the processor, batter, and audio device via the electronic cables.

Figure 8:
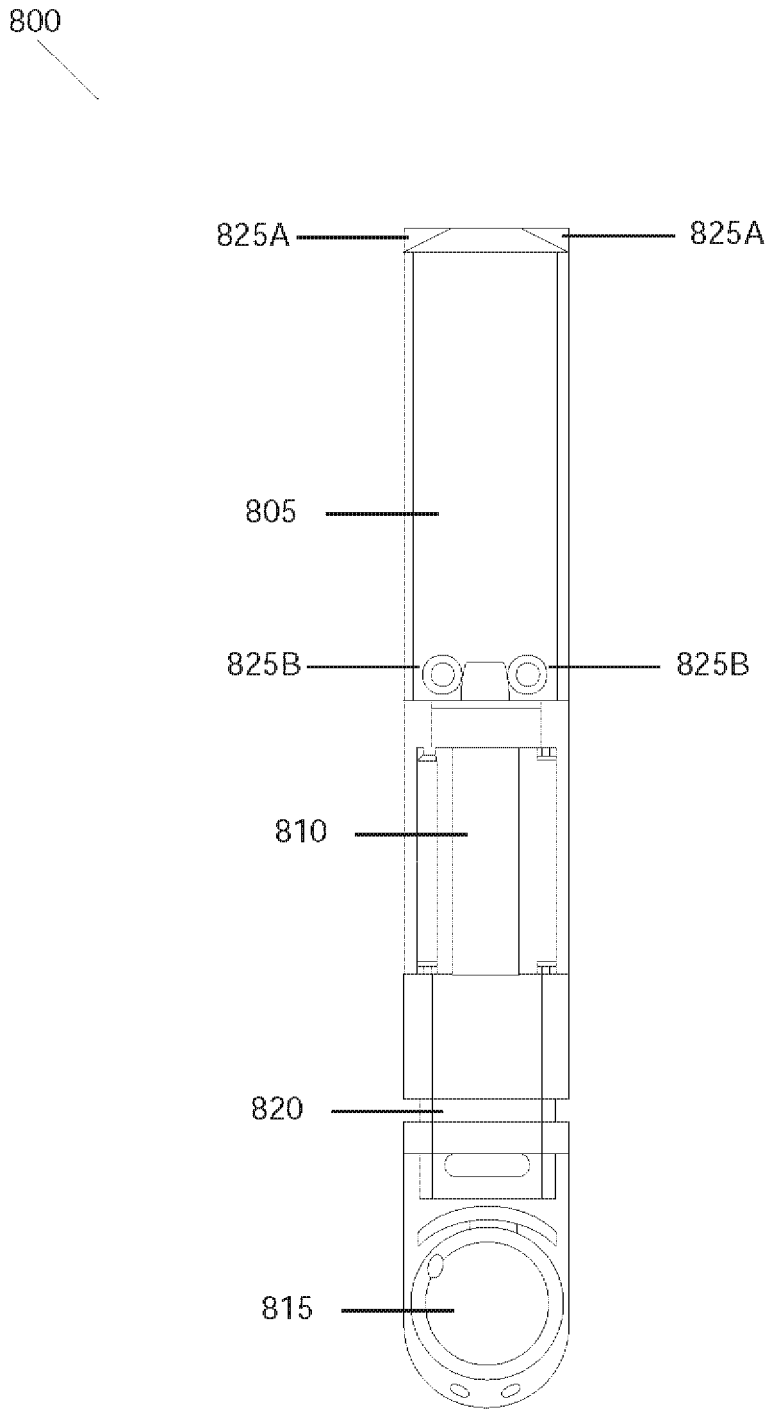
FIG. 8 illustrates a top-view of a module of the musical toothbrush, in accordance with an embodiment of the present invention.

FIG. 8 illustrates a top-view of a module 800, in accordance with an embodiment of the present invention. Module (or inner compartment) 800 can be housed in the second compartment and/or third compartment of the musical toothbrush. Module 800 can include one or more sub-compartments. For instance, module 800 includes an electronic board compartment 805, a battery compartment 810, an audio device compartment 815, and a slot 820 for a waterproof band.

Electronic board compartment 805 houses an electronic circuit board (not shown). In order for electronic board compartment 805 to house a processor or circuit board, mounts 825A and B are utilized. The circuit board can include a processor and two buttons that, when pressed, activate and/or deactivate the music. The circuit board can also include memory to store at least two audio, each audio having a playtime of two minutes. However, a person of ordinary skill in the art will readily appreciate that the audio can have a playtime of more or less than two minutes. For instance, the audio can have a playtime of one minutes, two minutes, three minutes, etc. Attached to the circuit board may be an illuminating device configured to illuminate the components of the toothbrush when audio is played.

One or more batteries housed in battery compartment 810 are configured to power the processor or circuit board. The one or more batteries are also configured to power the audio device. It should be appreciated that electronic cables (not shown) may electronically connect the processor, the one or more batteries, and the audio devices. The one or more batteries may be button batteries, thumb cell batteries, AAA batteries, or any type of battery that will be readily appreciated by a person of ordinary skill in the art. Battery compartment 810 is configured to allow the one or more batteries to be replaced. Audio device compartment 815 is configured to house the audio device (not shown).

Because liquid, water, or toothpaste may enter the toothbrush through the apertures described above when a person brushes his or her teeth, a waterproof band is utilized. The band is configured to prevent liquid, water, or toothpaste from entering battery compartment 810 and/or electronic board compartment 805. In other words, to prevent the processor or one or more batteries from malfunctioning, the band prevents liquid, water, or toothpaste from contacting the same. The band can be made of a rubber-like material, or any type of material that will prevent liquid, water, or toothpaste from entering battery compartment 810 and/or electronic board compartment 805.

Figure 9:
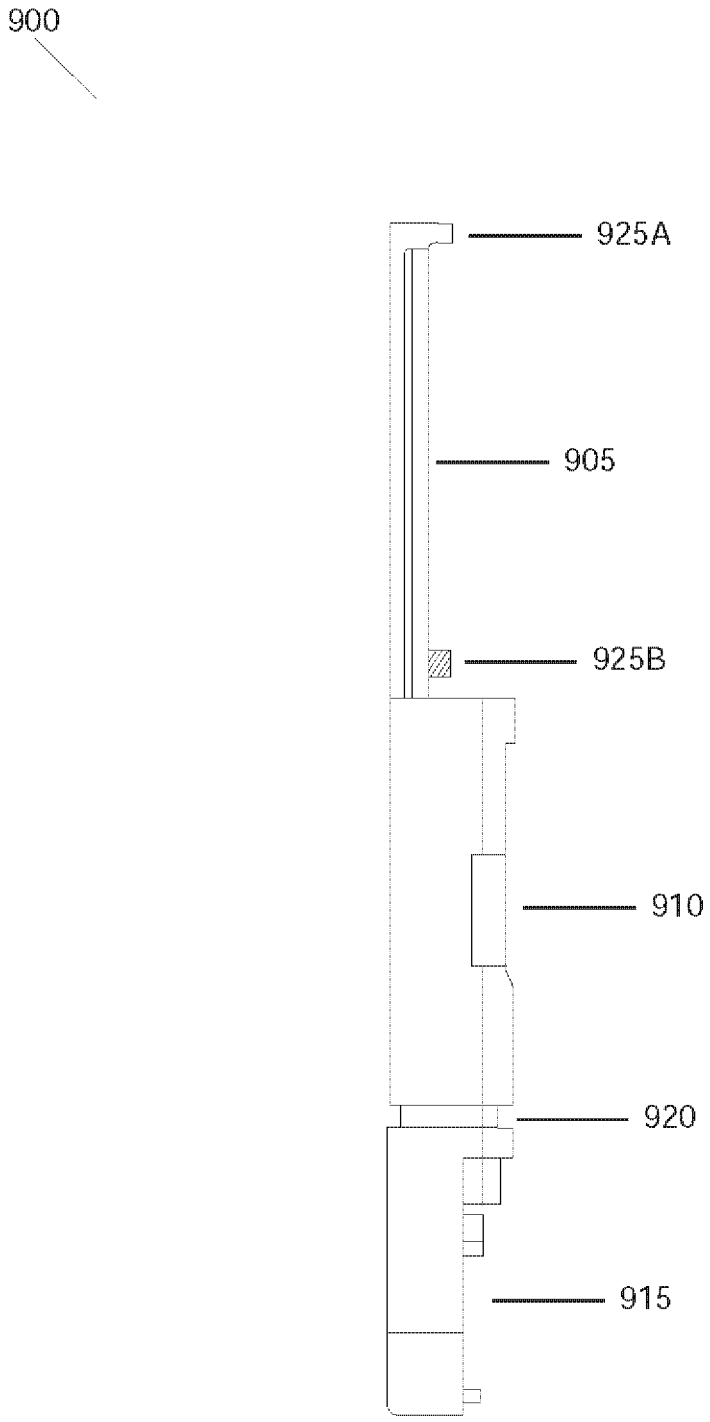
FIG. 9. Illustrates a side-view of a module of the musical toothbrush, in accordance with an embodiment of the present invention.

FIG. 9. Illustrates a side-view of a module 900 of the musical toothbrush, in accordance with an embodiment of the present invention. Module 900 includes an electronic board compartment 905, a battery compartment 910, an audio device compartment 915, and a slot 920 for a waterproof band. In order for electronic board compartment 905 to house a processor or circuit board, mounts 925A and B are utilized.

Figure 10:
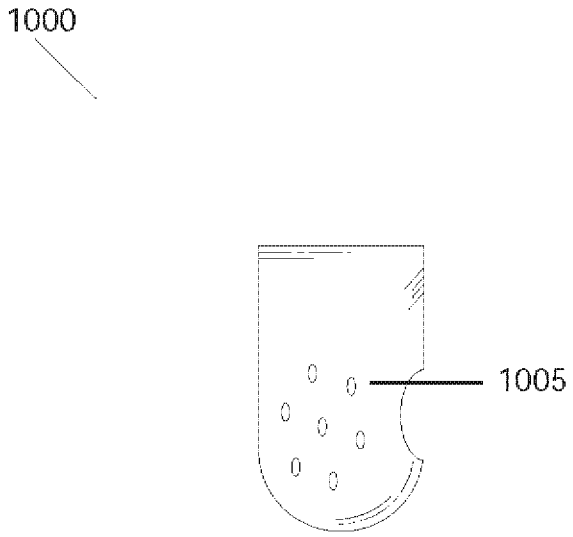
FIG. 10 illustrates an audio device cover, in accordance with an embodiment of the present invention.

FIG. 10 illustrates an audio device cover 1000, in accordance with an embodiment of the present invention. Generally, when water, liquid, or toothpaste enters the inner compartment described above through the apertures of the third compartment of the toothbrush, the audio, or sound, from the audio device becomes muffled. In order to prevent the audio from muffling or scattering, audio device cover 1000 is operatively connected to the audio compartment of the inner compartment of the toothbrush. Audio device cover 1000 includes openings 1005. Openings 1005 may be circular, rectangular, or any shape that would be appreciated by a person of ordinary skill in the art. Openings 1005 prevent water, liquid, or toothpaste from being confined to the inner compartment of the toothbrush and allow water, liquid, or toothpaste to exit the inner compartment of the toothbrush.

Furthermore, when audio device cover 1000 is connected to the audio compartment, a hollow space is created between the audio device housed in the audio compartment and audio device cover 1000. The hollow space allows sound waves to bounce from audio device cover 1000 onto the audio device and through openings 1005 in audio device cover 1000 and apertures. As a result, the sound, or audio quality, is enhanced.

Figure 11:
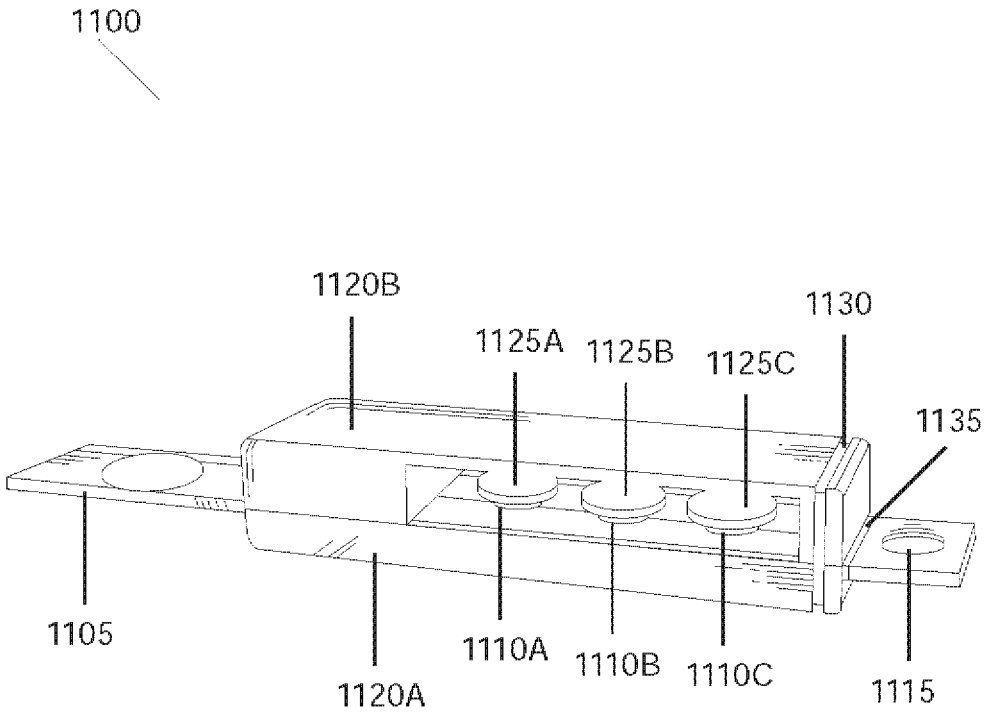
FIG. 11 illustrates a module of a musical toothbrush, in accordance with another embodiment of the present invention.

FIG. 11 illustrates a module 1100 of a musical toothbrush, in accordance with another embodiment of the present invention. Module (or inner compartment) 1100 includes a circuit board 1105. Circuit board 1105 can include, but is not limited to, a processor, memory, illuminating device, and buttons. Circuit board 1105 also includes battery holders 1110A-C and an audio device holder 1115. An upper compartment 1120A and lower compartment 1120B can be affixed to board 1105 to form a battery compartment. Because the battery compartment has opening on two side of module 1100, batteries 1125A-C can be removed or inserted from either side of the battery compartment. However, a person of ordinary skill in the art will readily appreciate that the batteries can be removed and inserted into battery holders 1110A-C in any direction.

The battery compartment also includes a waterproof slot 1130 that includes a band. The band prevents water, liquid or toothpaste from traversing inside the toothbrush. Also, in order to prevent water, liquid or toothpaste from entering the battery compartment, module 1100 utilizes waterproof epoxy glue 1135. However, it should be appreciated that any type of substance or material may be used in place of glue 1135 to prevent water from entering the battery compartment.

Figure 12:
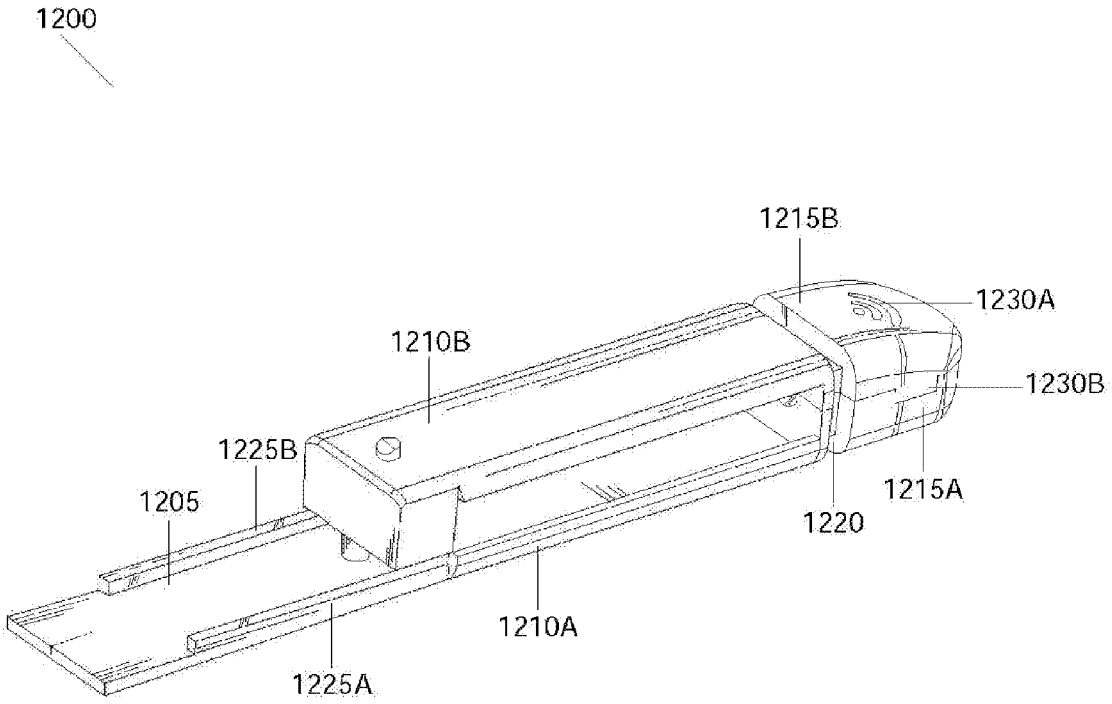
FIG. 12 illustrates a module of a musical toothbrush, in accordance with another embodiment of the present invention.

FIG. 12 illustrates a module 1200 of a musical toothbrush, in accordance with another embodiment of the present invention. Module 1200 includes an electronic board compartment 1205, a lower and upper battery compartment 1210A, B to hold the batteries and form a battery compartment, and a lower and upper audio device compartment 1215A, B to hold the audio device and form an audio device compartment. Electronic board compartment 1205 includes mounts 1225A, B to mount or hold the circuit board to module 1200. It should also be appreciated that the circuit board can be situated between mounts 1225A, B and extend into the battery compartment such that the circuit board may include replaceable batteries.

Module 1200 also includes a waterproof slot 1220 to prevent water, liquid, and/or toothpaste from entering the battery compartment or the circuit board compartment, via the audio device compartment. Upper audio device compartment 1215B includes apertures 1230A in order to prevent water, liquid and/or toothpaste from staying in the audio device compartment. Upper and lower audio device compartment 1215A, B are configured to form another aperture 1230B on both sides of the audio device compartment. Aperture 1230B also allows audio waves, as well as water, liquid, and/or toothpaste, to exit without any disturbance.

Figure 13:
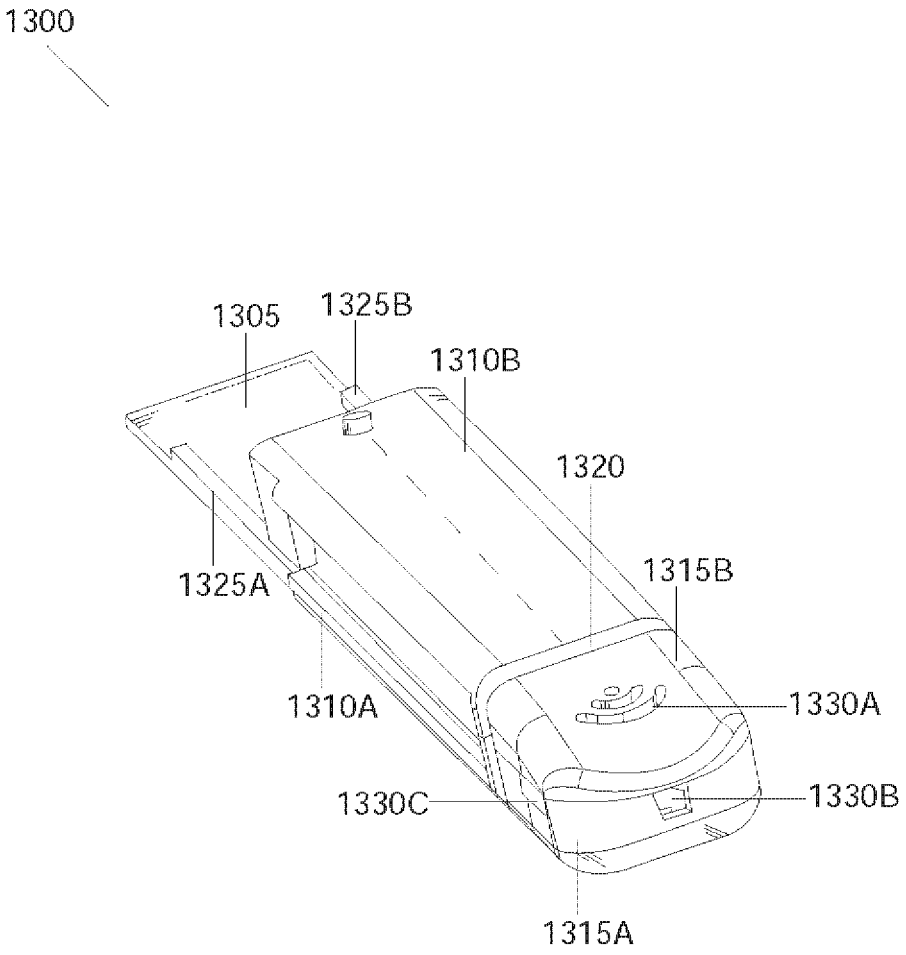
FIG. 13 illustrates a module of a musical toothbrush, in accordance with another embodiment of the present invention.

FIG. 13 illustrates a module 1300 of a musical toothbrush, in accordance with another embodiment of the present invention. Module 1300 includes an electronic board compartment 1305, a lower and upper battery compartment 1310A, B to hold the batteries, a lower and upper audio device compartment 1315A, B to hold the audio device. Electronic board compartment 1305 includes mounts 1325A, B to mount the circuit board to module 1300.

Module 1300 also includes a waterproof slot 1320 to prevent water, liquid, and/or toothpaste from entering the battery compartment or the circuit board compartment, via the audio device compartment. Upper audio device compartment 1315B includes apertures 1330A in order to prevent water, liquid and/or toothpaste from staying in the audio device compartment.

Upper and lower audio device compartment 1315A, B are configured to form another aperture 1330B, as well as aperture 1330C on both sides of the audio device compartment. Apertures 1230B and C allow audio waves, as well as water, liquid, and/or toothpaste, to travel and/or exit from the audio device compartment without any disturbance. This configuration is also beneficial, as the apertures prevent water, for example, from drying and malfunctioning the audio device.

Figure 14:
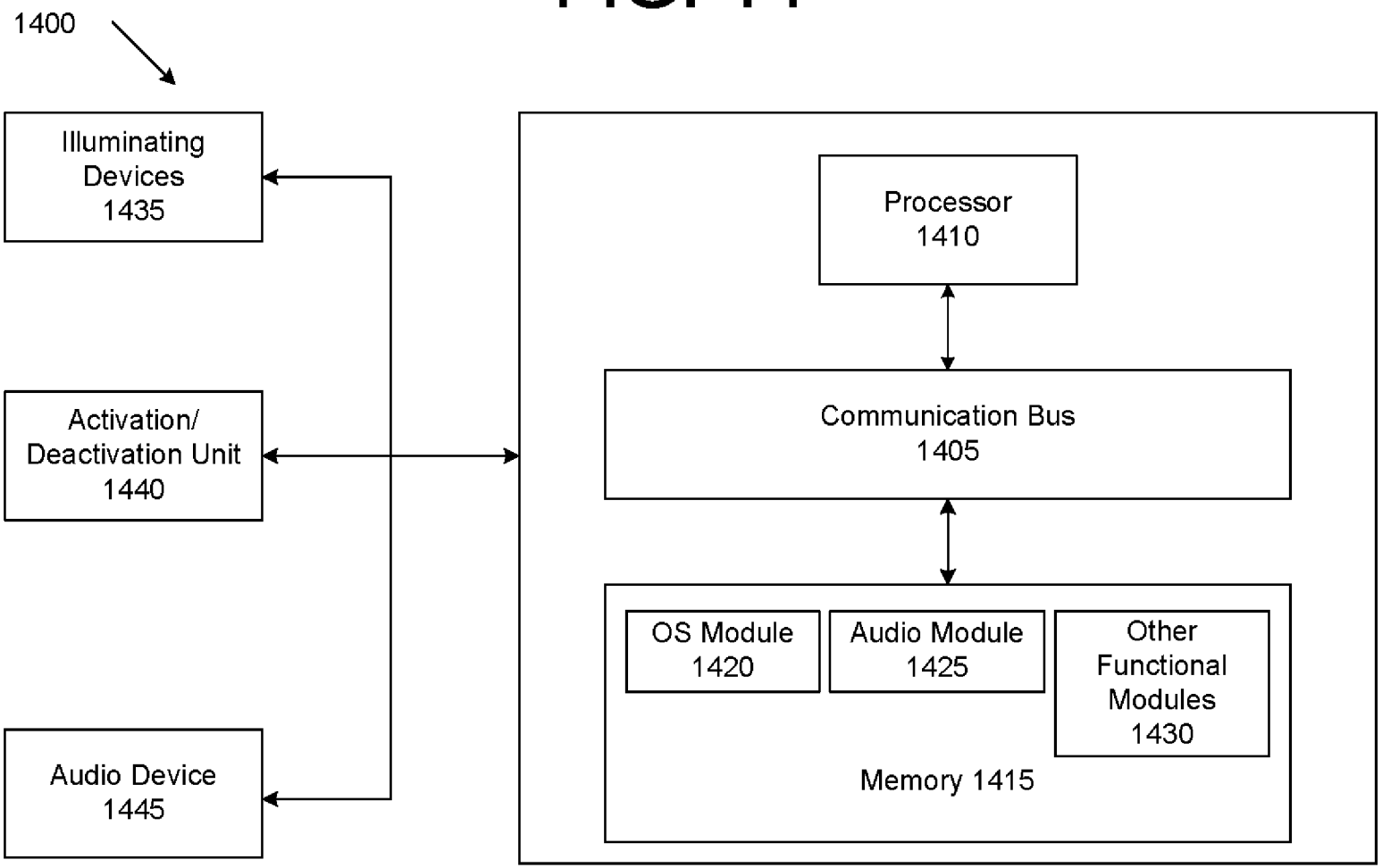
FIG. 14 is a block diagram illustrating a circuit board, according to an embodiment of the present invention.

FIG. 14 is a block diagram illustrating a circuit board 1400, according to an embodiment of the present invention. Circuit board 1400 may include a bus 1405 or other communication mechanism that can communicate information and a processor 1410, coupled to bus 1405, that can process information. Processor 1410 may be any type of general or specific purpose processor. Circuit board 1400 may also include memory 1415 configured to store information and instructions to be executed by processor 1410. Memory 1415 may include any combination of random access memory ("RAM"), read only memory ("ROM"), static storage such as a magnetic or optical disk, or any other type of computer readable medium.

The computer readable medium may be any available media that can be accessed by processor 1410. The computer readable medium may include both volatile and nonvolatile media, removable and non-removable media, and communication media. The communication media may include computer readable instructions, data structures, program modules, or other data and may include any information delivery media.

Processor 1410 can also be coupled via bus 1405 to an activation/deactivation unit(s) 1440 (e.g., switches) configured to activate or deactivate system 1400. For example, when circuit board 1400 is activated, music stored in audio module 1425 may be played via audio device 1445.

According to one embodiment, memory 1415 may store software modules that may provide functionality when executed by processor 1410. The modules can include an operating system module 1420 and audio module 1425 configured to store audio (e.g., music), as well as other functional modules 1430. Operating system module 1420 may provide operating system functionality for system 1400. Because system 1400 may be part of a larger system, system 1400 may include one or more additional functional modules 1430 to include the additional functionality.

For example, circuit board 1400 may include an illuminating module, as part of other modules 1430, configured to illuminate, via one or more illuminating devices 1435, the toothbrush, or various components of the toothbrush, when music stored in audio module 1425 is played. In one embodiment, illuminating devices 1435 may illuminate various components of the toothbrush synchronously with the beat of the music or for the duration of the music. Each of illuminating devices 1435 may illuminate simultaneously, sequentially, or randomly depending on the configuration of system 1400. It should be appreciated that illuminating devices 1435 may illuminate the same color or different colors depending on the configuration of system 1400.

It should be appreciated that circuit board 1400 also includes a power supply 1450. Power supply 1450 may be button batteries, thumb cell batteries, AAA batteries, AA batteries, or any type of battery that will be readily appreciated by a person of ordinary skill in the art.

One skilled in the art will appreciate that a "system" could be embodied as toothbrush, or any other device that would be appreciated by a person of ordinary skill in the art. Presenting the above-described functions as being performed by a "system" is not intended to limit the scope of the present invention in any way, but is intended to provide one example of many embodiments of the present invention. Indeed, methods, systems and apparatuses disclosed herein may be implemented in localized and distributed forms consistent with computing technology.

It should be noted that some of the system features described in this specification have been presented as modules, in order to more particularly emphasize their implementation independence. For example, a module may be implemented as a hardware circuit comprising custom very large scale integration ("VLSI") circuits or gate arrays, off-the-shelf semiconductors such as logic chips, transistors, or other discrete components. A module may also be implemented in programmable hardware devices such as field programmable gate arrays, programmable array logic, programmable logic devices, graphics processing units, or the like.

A module may also be at least partially implemented in software for execution by various types of processors. An identified unit of executable code may, for instance, comprise one or more physical or logical blocks of computer instructions that may, for instance, be organized as an object, procedure, or function. Nevertheless, the executables of an identified module need not be physically located together, but may comprise disparate instructions stored in different locations which, when joined logically together, comprise the module and achieve the stated purpose for the module. Further, modules may be stored on a computer-readable medium, which may be, for instance, a hard disk drive, flash device, RAM, tape, or any other such medium used to store data.

Figure 15A:
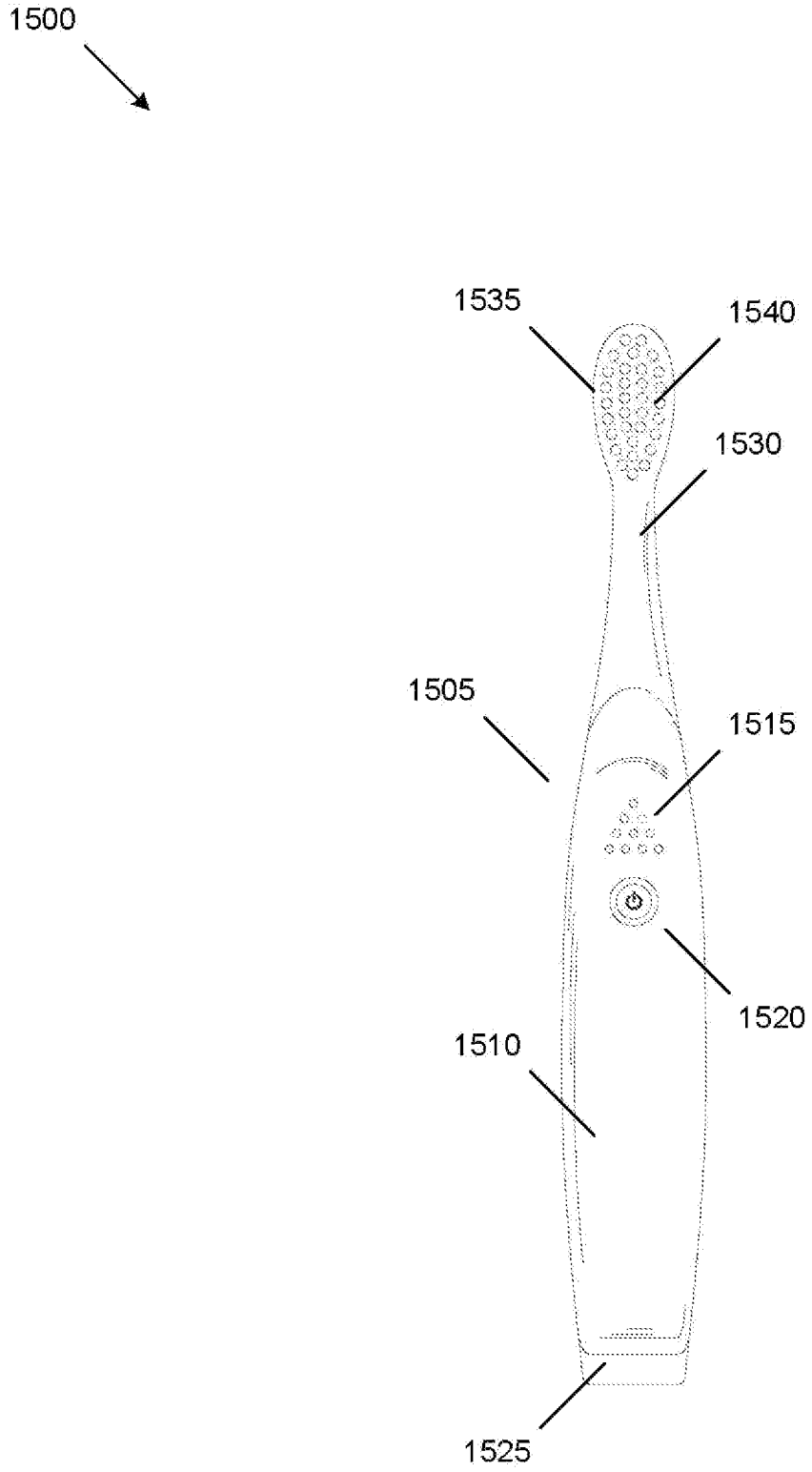
FIG. 15A-C is a block diagram illustrating a various views of musical toothbrush, according to an embodiment of the present invention.

Indeed, a module of executable code could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. FIG. 15A is a diagram illustrating a front-view of toothbrush 1500 having a single button, according to an embodiment of the present invention. Toothbrush 1500 may include the circuit board of FIG. 14 in this embodiment. Toothbrush 1500 may include a body segment 1505 that includes a grip mechanism 1510. Grip mechanism 1510 is configured to allow the user to securely hold toothbrush 1500 in his or her hand while he or she is brushing.

Grip mechanism 1510 also includes a thumb grip mechanism 1515 configured to allow the user to securely place his or her thumb on toothbrush 150 while he or she is brushing Toothbrush 1500 also includes an activation switch (or button) 1520. Activation switch 1520, when pressed by the user, may activate a stored audio for a predefined period of time, as well as activate illuminating lights configured to illuminate toothbrush 1500 according to the beat of the audio or for a predetermined period of time when the audio is played. In some embodiments, body segment 1505 and elongated segment 1530 may be composed of translucent material to allow the user to view the illumination. Also, in some embodiments, different segments of, or the entire, toothbrush 1500 may illuminate according to the beat of the audio or for a predetermined period of time when the audio is played.

Figure 15B:
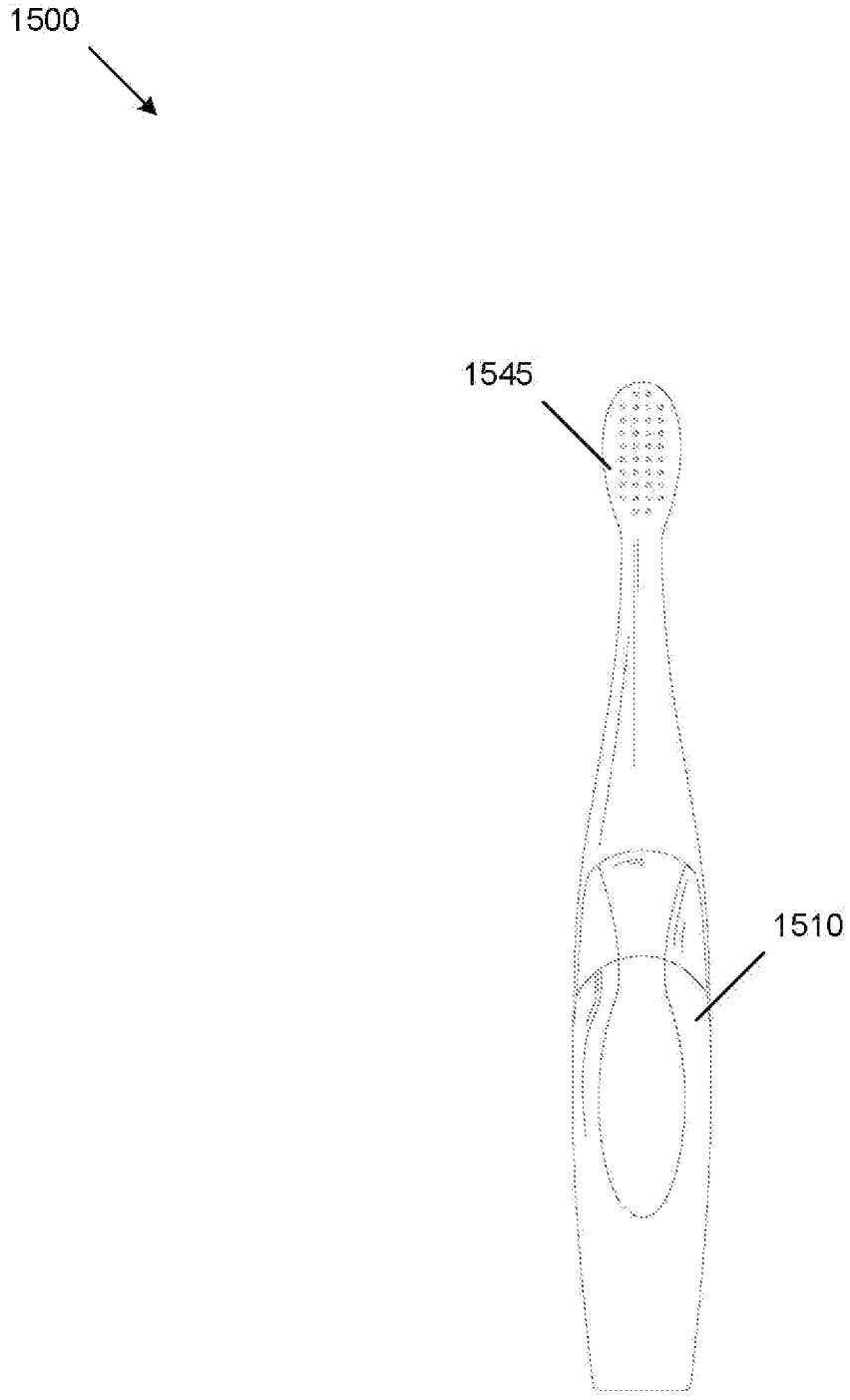
Figure 15C:
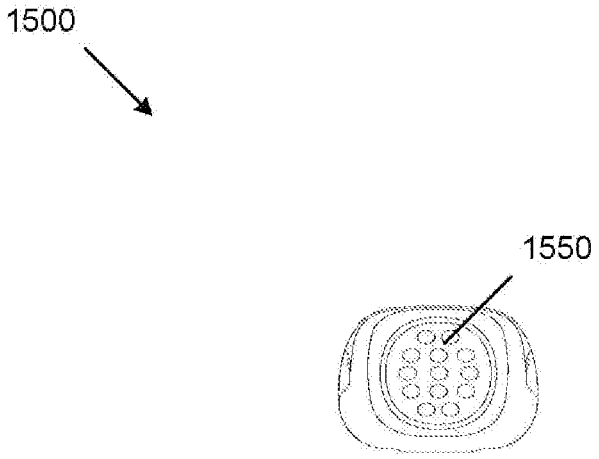

Toothbrush 1500 may also include a base 1525 configured to allow the user to place toothbrush 1500 upward when placed on the counter of a bathroom counter, for example. As shown in FIG. 15C, base 1525 may also include a plurality of holes 1550 configured to allow audio waves to pass through toothbrush 1500, such that the user may listen to the audio when played.

Toothbrush 1500 may also include an elongated segment 1530 of toothbrush 1500. Elongated segment 1530 may include a toothbrush head 1535 that also includes bristles 1540 of toothbrush 1500. As shown in FIG. 15B, the other side of toothbrush head 1535 may include a tongue cleaner 1545 configured to allow a user to clean his or her tongue during or after brushing.

It should be appreciated that a computer program may control the electronic functionalities of the toothbrush. The computer program may be embodied on a non-transitory computer readable medium. The computer readable medium may be, but is not limited to, a hard disk drive, a flash device, a random access memory, a tape, or any other such medium used to store data. The computer program product may include encoded instructions for controlling the nonlinear adaptive processor to implement the functions of the toothbrush.

The computer program can be implemented in hardware, software, or a hybrid implementation. The computer program can be composed of modules that are in operative communication with one another, and which are designed to pass information or instructions to display. The computer program can be configured to operate on a general purpose computer, or an application specific integrated circuit ("ASIC").

One having ordinary skill in the art will readily understand that the invention as discussed above may be practiced with steps in a different order, and/or with hardware elements in configurations that are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

at least one illuminating device enclosed within a body of the apparatus;

an audio device configured to play audio when the apparatus is activated, wherein the at least one illuminating device is configured to illuminate the body of the apparatus for a predetermined period of time, and illuminate synchronously with beats or tempo of the audio, when the audio is played; and at least one illuminating device enclosed within a head of the apparatus, and configured to illuminate the head of the apparatus when the audio is played, wherein the head of the apparatus comprises a rubber coating, and the at least one illuminating device enclosed within the head of the apparatus is further configured to illuminate the rubber coating when the audio is played.

2. The apparatus of claim 1, wherein the audio device is configured to play the audio when the apparatus is activated.

3. The apparatus of claim 1, wherein the audio device is configured to stop the audio when the apparatus is deactivated.

4. An apparatus, comprising:

at least one illuminating device enclosed within each component of the apparatus; and an audio device configured to play audio when the apparatus is activated, wherein each of the illuminating devices is configured to illuminate each component of the apparatus for a predetermined period of time, and illuminate synchronously with beats or tempo of the audio, when the audio is played, the at least one illuminating device enclosed within a head component of the apparatus, and configured to illuminate the head component of the apparatus when the audio is played, the head of the apparatus comprises a rubber coating, and the at least one illuminating device enclosed within the head component of the apparatus is further configured to illuminate the rubber coating when the audio is played.

5. The apparatus of claim 4, wherein each of the illuminating devices are configured to simultaneously illuminate each component of the apparatus for the predetermined period of time when the audio is played.

6. The apparatus of claim 4, wherein each of the illuminating devices are configured to sequentially illuminate each component of the apparatus for the predetermined period of time when the audio is played.

7. The apparatus of claim 4, wherein each of the illuminating devices are configured to randomly illuminate each component of the apparatus for the predetermined period of time when the audio is played.

8. The apparatus of claim 4, further comprising:

memory configured to store a first audio recording and a second audio recording.

9. The apparatus of claim 8, further comprising:

a first switch configured to cause the audio device to play the first audio for a predetermined time period.

10. The apparatus of claim 8, further comprising:

a second switch configured to cause the audio device to output the second audio for a predetermined time period.

11. An apparatus, comprising:

a plurality of illuminating devices enclosed within the apparatus;

at least one switch configured to cause an audio device to play audio and cause the plurality of illuminating devices to illuminate the apparatus for a predetermined period of time, and illuminate synchronously with beats or tempo of the audio, when the audio is played; and an illuminating device enclosed within a head of the apparatus, and configured to illuminate the head of the apparatus when the audio is played, wherein the head of the apparatus comprises a rubber coating, and the illuminating device enclosed within the head of the apparatus is further configured to illuminate the rubber coating when the audio is played.

12. The apparatus of claim 11, wherein the each of the plurality of illuminating devices is configured to illuminate each component of the apparatus.

13. The apparatus of claim 12, wherein each component of the apparatus houses one of the plurality of illuminating devices.

14. The apparatus of claim 12, wherein each of the plurality of illuminating devices is configured to simultaneously illuminate each component of the apparatus.

15. The apparatus of claim 12, wherein each of the plurality of illuminating devices is configured to randomly illuminate each component of the apparatus.

16. The apparatus of claim 1, wherein the at least one illuminating devices is configured to simultaneously illuminate each component of the apparatus synchronously with beats or tempo of the audio.

17. The apparatus of claim 1, further comprising:

a processor; and memory comprising the audio, wherein the processor is configured to cause the at least one illuminating device to illuminate the body of the apparatus, and illuminate synchronously with the beats or tempo of the audio, when the audio is played.

* * * * *